United States Patent [19]

Cap

[11] 3,937,996

[45] Feb. 10, 1976

[54] METAL HALIDE LAMP USING LOOP ELECTRODES

[75] Inventor: Daniel M. Cap, Kirtland, Ohio

[73] Assignee: General Electric Company, Schenectady, N.Y.

[22] Filed: Oct. 7, 1974

[21] Appl. No.: 512,705

[52] U.S. Cl. ..... 313/217; 313/229; 313/344

[51] Int. Cl.[2] ..... H01J 61/06

[58] Field of Search..... 313/217, 229, 344

[56] References Cited

UNITED STATES PATENTS

| | | | |
|---|---|---|---|
| 2,123,015 | 7/1938 | Marden et al. | 313/217 UX |
| 3,313,974 | 4/1967 | Koury et al. | 313/218 |
| 3,356,884 | 12/1967 | Decker et al. | 313/217 X |
| 3,689,794 | 9/1972 | Van Esdonk | 313/217 X |

*Primary Examiner*—R. V. Rolinec
*Assistant Examiner*—Darwin R. Hostetter
*Attorney, Agent, or Firm*—Ernest W. Legree; Lawrence R. Kempton; Frank L. Neuhauser

[57] ABSTRACT

A metal vapor arc lamp having a filling including pyrolitically decomposing metal halides such as thorium iodide uses a loop electrode which allows the heat from the hot spot to flow in two directions. Such electrodes are less expensive to manufacture and, in an environment where the decomposing metal halide provides activation, they are less subject to deformation and consume less energy than conventional electrodes comprising shank plus overwind.

10 Claims, 5 Drawing Figures

METAL HALIDE LAMP USING LOOP ELECTRODES

This invention relates to high pressure metal halide vapor lamps and particularly to a new construction of electrode which improves efficiency and color stability and which facilitates manufacture and reduces cost.

BACKGROUND OF THE INVENTION

The type of electrode which is in almost universal use in high pressure metal vapor lamps comprises a rod or shank around which is wound a tungsten coil structure. A common design is a two-layer coil wherein the inner layer has spaced turns and the outer layer is close wound and screwed over the first. The interstices between turns are filled with emissive material which is retained in place by the outer layer. Emissive materials commonly used are oxides of low work function materials such as thorium oxide or mixtures of alkaline earth oxides including barium oxide. The shank projects through the coil and forms a tip to which the arc attaches with formation of a hot spot.

In such electrodes the emissive material or activator reaches the tip by diffusion over the surface in a process which is strongly temperature dependent. With a high tip temperature, electron emission is large and the cathode fall is low but the evaporation rate of emission material is large. Reducing the tip temperature reduces the evaporation rate but electron emission is decreased, cathode fall increases and sputtering by ion bombardment may take place. The common electrode design problem is to arrange the dispensing of the activator so that it balances the rate of loss. Since this cannot be done exactly, the compromise generally adopted is to design the electrode for an excess rate of activator supplied to the tip and to provide an ample reservoir of emissive material in the coil structure. Accordingly, the electrodes of high intensity discharge lamps have tended to be relatively large massive wound tungsten coil structures which are difficult to locate accurately in the ends of the fused silica envelopes into which they are pinch-sealed.

It is known that in metal halide lamps having a fill including thermally decomposing metal halides such as thorium iodide $ThI_4$, pyrolytic decomposition of the thorium iodide followed by condensation of thorium metal on the electrode surface yields a surface which emits electrons efficiently. The thorium layer shields the tungsten from erosion. As for the thorium, an iodine transport cycle continually replenishes the quantity of thorium on the electrode tip. An efficient electrode activation system is thus available but up to the present it has been used with the relatively massive wound tungsten electrode structures developed for the prior art electron emissive materials. The object of the invention is to provide improved and more efficient electrode structures taking greater advantage of the characteristics of pyrolitically decomposing metal halides for electrode activation.

SUMMARY OF THE INVENTION

Since activation of an electrode surface via the mechanism of pyrolytic decomposition of a metal halide present as part of the vapor filling does not require a structure with an emission mix reservoir, a radical departure from the usual shank plus overwind structure becomes possible. In accordance with my invention, I provide an electrode having an open loop geometry which may be made of tungsten or of more easily formed material such as tantalum or tantalumtungsten alloy. My loop electrodes are lighter, smaller and cheaper than prior electrodes, they are more efficient electron emitters, they are geometrically more stable and less subect to deformation, and they are more easily and accurately pinch-sealed into fused silica envelopes.

A metal halide lamp embodying my invention in preferred form comprises open loop electrodes of tungsten wire mounted in the ends of a fused silica envelope with the axes of the loops normal to the interelectrode axis. Both legs or ends of the wire forming the loop may extend to and be attached to the foil forming part of the electrode inlead. The loop may be formed as a simple hairpin or may include one or more turns depending upon the desired current carrying capacity and temperature distribution. The pyrolytically decomposable metal halide contained in the lamp is thorium tetraiodide, and the lamp also contains mercury, sodium iodide, scandium triiodide and an inert starting gas such as argon.

DETAILED DESCRIPTION

Figure 1:
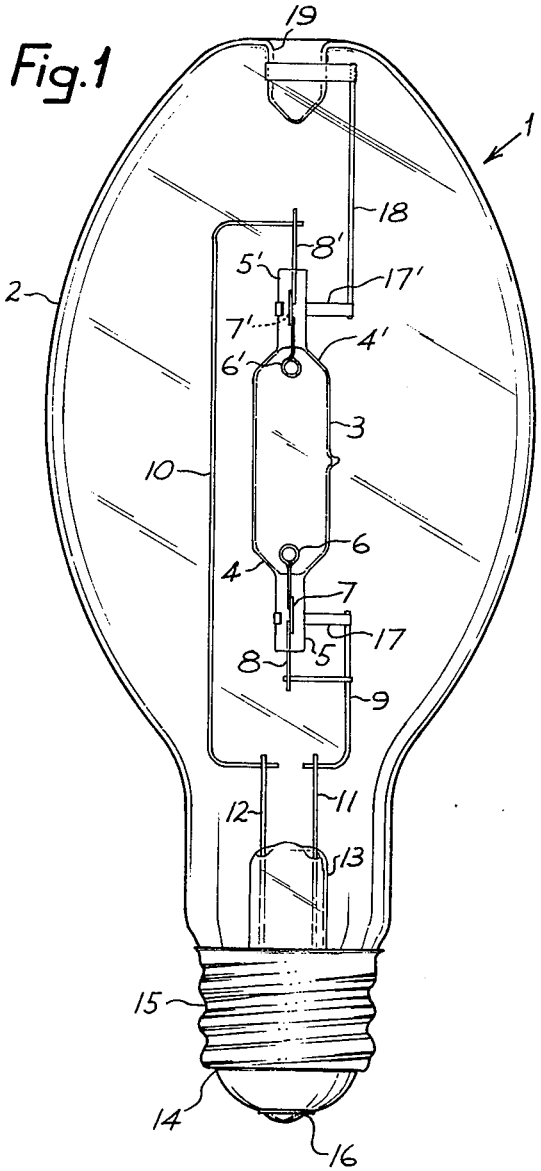
FIG. 1 is a side view of a metal halide lamp in which the arc tube is provided with loop electrodes embodying the invention.

FIG. 1 shows a metal halide lamp 1 of 400 watt size utilizing my improved loop electrodes. It comprises an outer glass envelope 2 containing a quartz or fused silica are tube 3 having conical ends 4,4' tapering down into small diameter necks 5,5'. The loop electrodes 6,6' embodying the invention are mounted in opposite ends of the arc tube with the loop portions proper located within the conical shoulder portions. The loop electrodes extend from inleads comprising intermediate molybdenum foils 7,7' and outer inlead portions 8,8' through which current is conducted to the electrodes. The hermetic seals are made at the molybdenum foils 7,7' upon which the fused silica of the necks is pressed during the pinch sealing operation. Inlead portions 8,8' are connected by conductors 9,10 to outer envelope inleads 11, 12 sealed through stem 13 of the outer envelope or jacket 2. The outer envelope inleads are connected to the contact surfaces of screw base 14 attached to the neck end of the envelope, that is to the threaded shell 15 and to the insulated center contact 16. The arc tube is supported within the outer envelope primarily by the metal straps 17,17' which wrap around the necks and which are attached respectively to conductor 9 and to a support member 18 which engages inverted nipple 19 at the dome end of the outer envelope.

My improved loop electrodes require that there be present in the arc tube as part of the vapor through which the discharge takes place a compound of a metal of low work function which is subject to pyrolytic decomposition and plating out on the electrodes. Further the compound must participate in a transport cycle such as a halogen transport cycle which continually returns to the electrode the low work function metal which is lost therefrom by vaporization or other processes. Materials which will serve this function are low work function metals which can be purified via the van Arkel process such as thorium tetraiodide $ThI_4$, lanthanum triiodide $LaI_3$, and uranium tetraiodide $UI_4$.

In the preferred embodiment of the invention illustrated in FIG. 1, the arc tube contains a quantity of mercury which is substantially completely vaporized and exerts a partial pressure in the range of 1 to 15 atmospheres during operation. In addition it contains metal iodides in excess of the quantities vaporized at the operating temperature which includes sodium iodide, scandium iodide, and thorium idodide. An inert rare gas at a low pressure, for instance argon at 25 torr, is included in the arc tube to facilitate starting and warm-up.

In operation, thorium iodide is decomposed by the heat of the arc and thorium metal condenses on the electrode surface. The arc originates from a hot spot which occurs at the front end of the loop close to the points where the interelectrode distance is least. A small molten pool of thorium is formed which erodes by evaporation but the supply of thorium is continually replenished by reason of the iodine transport cycle. In the cycle, iodine released by decomposition of thorium iodide at the electrode diffuses throughout the arc tube and reacts with thorium at the walls or at any other places where it may have condensed and reforms sodium tetraiodide. The sodium tetraiodide circulates through the arc tube in the vapor phase and decomposition thereof by the heat of the arc in the vicinity of the hot spot renews the supply of thorium on the electrode. This cyclic process returns to the cathode any thorium activator lost and results in an efficient long-lived cathode.

For a long-lived electrode, a steady state operating mode must be achieved wherein the amount of thorium evaporated from the electrode-arc interface is exactly balanced by the amount returned through pyrolytic decomposition of $ThI_4$. The geometry of the loop electrode must be adjusted such that the temperature distribution in operation causes a substantial portion of the thorium in the lamp to be condensed at the front of the loop. The loop electrode may be analogized to a hairpin having at the end anywhere from one half turn up to any number of turns desired. Such a design splits the heat dissipated by the electrode structure into two approximately equal portions which are transported via thermal conduction into the seal area. The design also subjects the lateral surfaces of the wire to the erosion stresses which occur during life by contrast with the conventional shank plus overwind structure where the arc electrode interface usually attaches to the tip of the shank. I have found that my loop electrodes are dimensionally more stable than the shank plus overwind construction wherein the shank tends to slump down into the overwind coil.

Figure 2:
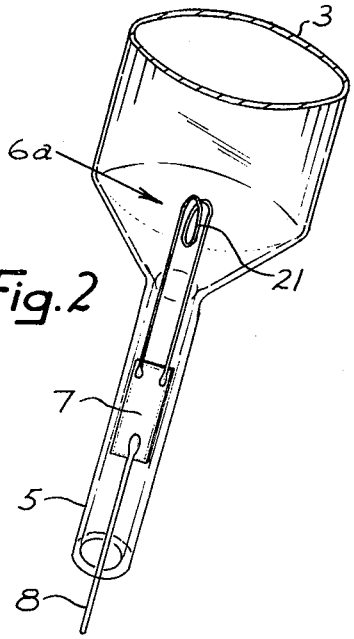
FIG. 2 is a pictorial view to a larger scale showing one end of the arc tube with the loop electrode extending through the neck prior to pinching.

The loop electrode permits a lightweight design as illustrated in FIGS. 2 to 5. In FIG. 2 loop electrode 6a comprises a tungsten or a thoriated tungsten wire formed into a 1-½ turn loop 21 with both ends or legs of the wire welded to molybdenum foil 7. The electrode is shown in place for pinch sealing within the neck 5 of a fused silica envelope 3. The turns 21 are so dimensioned that the electrode can be inserted with enough clearance to avoid binding through the small diameter neck 5 as illustrated. When inserted, the electrode is supported by the neck and the wire loop structure is so light that it is supported by the foil without any distortion taking place. To make the seal, the silica neck 5 is heated to the softening point while an inactive gas is caused to flow through it to prevent oxidation of the metal parts. A pair of jaws then closes upon the neck in the region of the foil to press the silica into wetting contact with the foil and thereby achieve a hermetic seal. Alternatively the seals may conveniently be made by vacuum shrinking.

Figure 3:
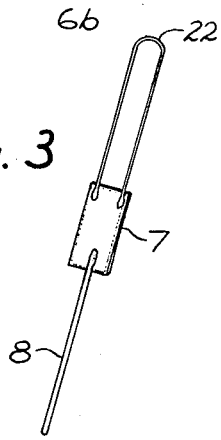

In FIG. 3 loop electrode **6*b* comprises a tungsten wire 22 formed to a half-turn or simple hairpin shape and having both legs welded to molybdenum foil 7**.

Figure 4:
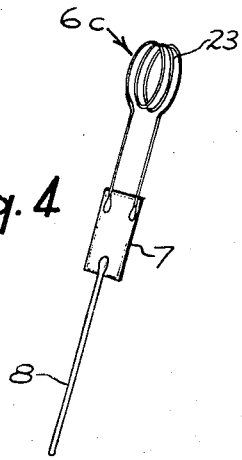

In FIG. 4 loop electrode **6*c* comprises a tungsten wire formed to a three-turn loop 23 and again having both ends or legs welded to a molybdenum foil 7. In all the loop electrode designs of FIGS. 2 to 4** the heat dissipation is split by the two leg portions for conduction into the seal area.

Figure 5:
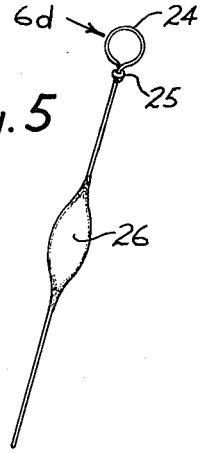
FIGS. 3 to 5 are pictorial views to a larger scale of a variety of loop electrodes embodying the invention.

In FIG. 5 a loop electrode **6*d* is illustrated as a variant of the invention wherein the entire electrode including the inlead portion is made from a single piece of tungsten wire. A single loop 24 is formed in one end of the wire which is twisted and locked upon itself at 25. An intermediate foliated portion 26 for sealing into silica is formed by rolling or swaging the wire. The single piece electrode of FIG. 5 does not have heat conduction by two legs into the seal area and must be differently proportioned for an equivalent heat balance. In other respects it operates in the same fashion as the electrodes illustrated in FIGS. 2 to 4**.

What I claim as new and desire to secure by Letters Patent of the United States is:

1. A metal halide vapor arc lamp comprising:

a fused silica envelope;

an ionizable filling within said envelope comprising mercury, an inert starting gas and metal halide including at least one pyrolytically decomposable metal halide of low work function capable of serving as activator of a higher work function refractory metal to promote electron emission therefrom;

and electrodes sealed into opposite ends of said envelope, said electrodes being of refractory metal wire formed into open loops with their axes normal to the inter-electrode axis, said lamp operating with a temperature distribution permitting condensation of metal from said pyrolytically decomposable metal halide on said electrodes.

2. A lamp as in claim 1 wherein each electrode comprises a refractory metal wire formed into at least a half turn open loop at its forward end and having the legs extending from said loop attached to a foliated conductor which is pinch-sealed into an end of the envelope.

3. A lamp as in claim 1 wherein each electrode comprises a refractory metal wire formed into at least one full turn open loop at its forward end and having the legs extending from said loop attached to a foliated conductor which is pinch-sealed into an end of the envelope.

4. A lamp as in claim 1 wherein the pyrolytically decomposing metal halide is a low work function metal which can be purified by the van Arkel process.

5. A lamp as in claim 1 wherein the pyrolytically decomposing metal halide is selected from the group consisting of thorium tetraiodide, lanthanum triiodide, uranium tetraiodide and mixtures thereof.

6. A lamp as in claim 1 wherein each electrode is formed by a refractory metal wire shaped into an open loop at its forward end and into a foliated portion at an intermediate point which is pinch-sealed through an end of the envelope.

7. A metal halide vapor arc lamp comprising:

a fused silica envelope;

an ionizable filling within said envelope comprising a quantity of mercury which is substantially totally vaporized in operation, sodium iodide, scandium triiodide and thorium tetraiodide in excess of the quantities vaporized, and an inert starting gas;

and electrodes mounted in opposite ends of said envelope, said electrodes being of tungsten wire formed into open loops attached to inleads including thin sealing foil portions, said foil portions being pinch-sealed through narrow necks in the ends of said envelope and supporting said electrodes with the axes of the loops normal to the inter-electrode axis, said lamp operating with a temperature distribution causing condensation of thorium on the electrodes where it serves as activator and where the supply is continually replenished by a transport cycle involving decomposition of thorium tetraiodide in the hotter regions of the envelope and reaction of released iodine and condensed thorium in the cooler regions to reform thorium tetraiodide.

8. A lamp as in claim 7 wherein each electrode comprises a refractory metal wire formed into at least a half turn open loop at its forward end and having the legs extending from said loop attached to the sealing foil portion of the inleads.

9. A lamp as in claim 7 wherein each electrode comprises a refractory metal wire formed into at least one full turn open loop at its forward end and having the legs extending from said loop attached to the sealing foil portion of the inleads.

10. A lamp as in claim 7 wherein each electrode comprises a refractory metal wire shaped into an open loop at its forward end and into a foliated portion at an intermediate point to form the inlead sealing foil portion.

* * * * *